United States Patent [19]

Dean

[11] 4,259,887

[45] Apr. 7, 1981

[54] TABLE SAW MITRE GAUGE EXTENSION

[76] Inventor: Glenn L. Dean, P.O. Box 297, North Platte, Nebr. 69101

[21] Appl. No.: 63,991

[22] Filed: Aug. 6, 1979

[51] Int. Cl.[3] ..... B27B 27/08

[52] U.S. Cl. ..... 83/437; 83/422; 83/435.1; 83/473; 83/522; 83/581; 144/253 R; 33/173

[58] Field of Search ..... 83/422, 435.1, 437, 83/473, 522, 581; 144/253 R; 33/173 R, 500

[56] References Cited

U.S. PATENT DOCUMENTS

| | | | |
|---|---|---|---|
| 1,299,367 | 4/1919 | McMichael et al. | 83/437 |
| 1,319,179 | 10/1919 | Royle | 83/437 X |
| 2,237,556 | 4/1941 | Hedgpeth | 83/437 X |
| 2,667,190 | 1/1954 | Delano | 144/253 R |
| 2,787,301 | 4/1957 | Anderson | 83/437 |
| 2,884,965 | 5/1959 | Stahl | 83/437 X |
| 3,083,744 | 4/1963 | Vold | 83/437 X |

*Primary Examiner*—Donald R. Schran
*Attorney, Agent, or Firm*—Richard L. Miller

[57] ABSTRACT

A device attachable to a table saw mitre gauge, the device including a flat plate that adjustably bolts to the gauge so as to give a longer surface against which work is held and the flat plate supports an adjustable block against which an end of the work can be abutted for controlling a length of the work that is being sawed.

2 Claims, 3 Drawing Figures

10
11
15
17
18
19
20
21
22
23
24
25
26
27
28
29
30
31
32

0
45
90
135
10
11
12
15
17
18
20
22
24
26
28
29

10
11
13
14
15
16
33
34
35
36

TABLE SAW MITRE GAUGE EXTENSION

BACKGROUND OF THE INVENTION

This invention relates generally to table saw mitre gauges. It is well know to those persons acquainted with working with a table saw, that it is not feasable, and at a same time is dangerous, to attempt cutting small pieces of wood with a conventional rip fence or mitre gauge, so that this situation is according in need of an improvement.

SUMMARY OF THE INVENTION

Therefore it is a principal object of the present invention to provide a table saw mitre gauge extension that eliminates the danger of cutting small pieces of wood with a conventional rip fence, and which allows straight cutting a piece of wood of less than 8 inches length with a mitre gauge, or cutting a wood less than 10 inches long at any angle.

Another object is to provide a table saw mitre gauge extension which will allow a large number of wood pieces to all be cut an exactly same length, one after another without need to measure each individually.

Still a further object is to provide a table saw mitre gauge extension which gives extreme accuracy and consistancy on any angle or compound angle cuts, and which allows cutting of thin, flexible and soft materials accurately which otherwise would not be possible with a conventional mitre gauge.

Still another further object is to provide a table saw mitre gauge extension which will work on either side of a saw blade, and which is universal so to fit on all table saw mitre gauges.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF DRAWING FIGURES

DETAILED DESCRIPTION OF PREFERRED EMBODIMENTS

Figure 1:
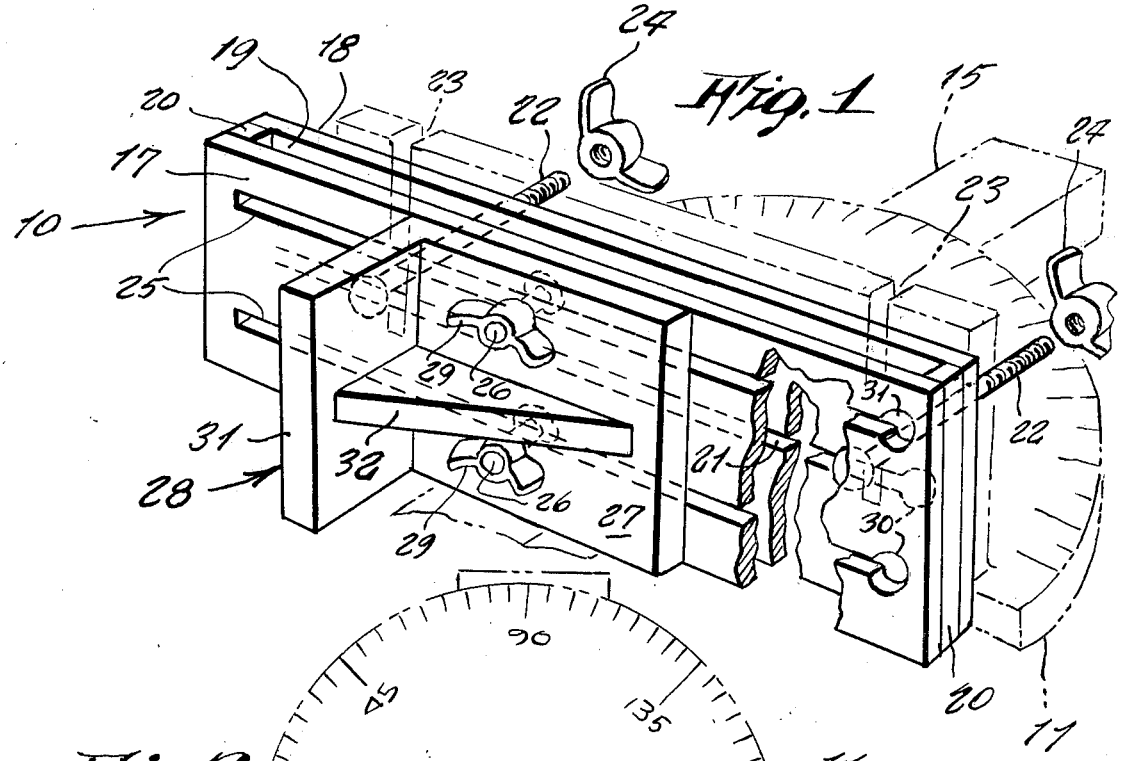
FIG. 1 is a front perspective view of the invention, shown partly broken away so as to indicate the rear side single slot.
Figure 2:
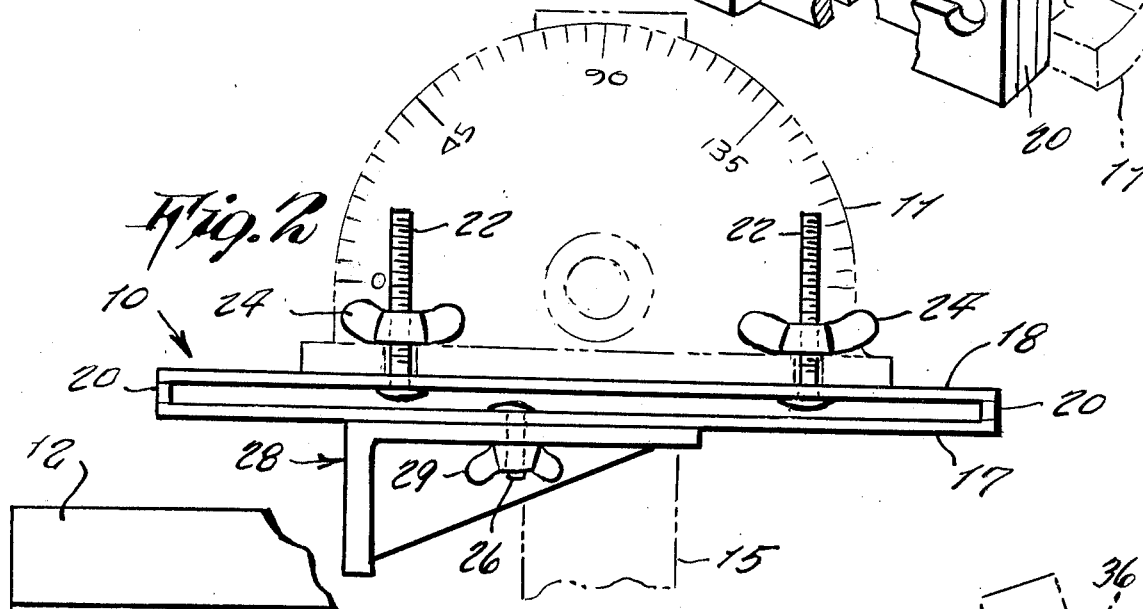
FIG. 2 is a top view of the device.

Referring now to the drawing in greater detail, the numeral 10 represents an extension for a mitre gauge 11 of a saw table 12 having a circular saw 13 within a slot 14 thereof and driven by a motor under the table. The mitre gauge is mounted on a block 15 slidable in a groove 16 on an upper side of the table.

In the present invention, the extension 10 comprises a front plate 17 and parallel rear plate 18 with a central space 19 therebetween, the plates being affixed integrally together by a spacer 20 affixed therebetween at opposite ends thereof.

The rear plate has a single horizontal slot 21 for receiving a pair of carriage bolts 22 fitted in slots 23 of the mitre gauge. A wing nut 24 is on each carriage bolt 22.

The front plate has two horizontal slots 25 for each receiving a carriage bolt 26 extending through a base 27 of a rip fence 28, and a wing nut 29 is on each carriage bolt 26.

Each slot 21 and 25 may have an enlarged hole 30 near one end thereof so that a head of the bolts 22 and 26 can be inserted therethrough in order that the bolt heads are inside the central space 19 with the heads bearing against the plates, while the bolts protrude outwardly from both sides of the extension.

The rip fence 28 is L-shaped by having a face plate 31 at right angle to the base 27. A triangular brace 32 is made integrally between the base and face plate.

In operative use, the extension is adjusted relative to the mitre gauge by means of the bolts 22 being slided in the slot 21 and the wing nuts 24 then being tightened so to hold the extension firmly against the mitre gauge in the selected position. The rip fence 28 is then adjusted respective to the extension by means of bolts 26 being slided in slots 25, and the wing nuts 29 then being tightened so as to firmly lock the rip fence in the selected position.

Figure 3:
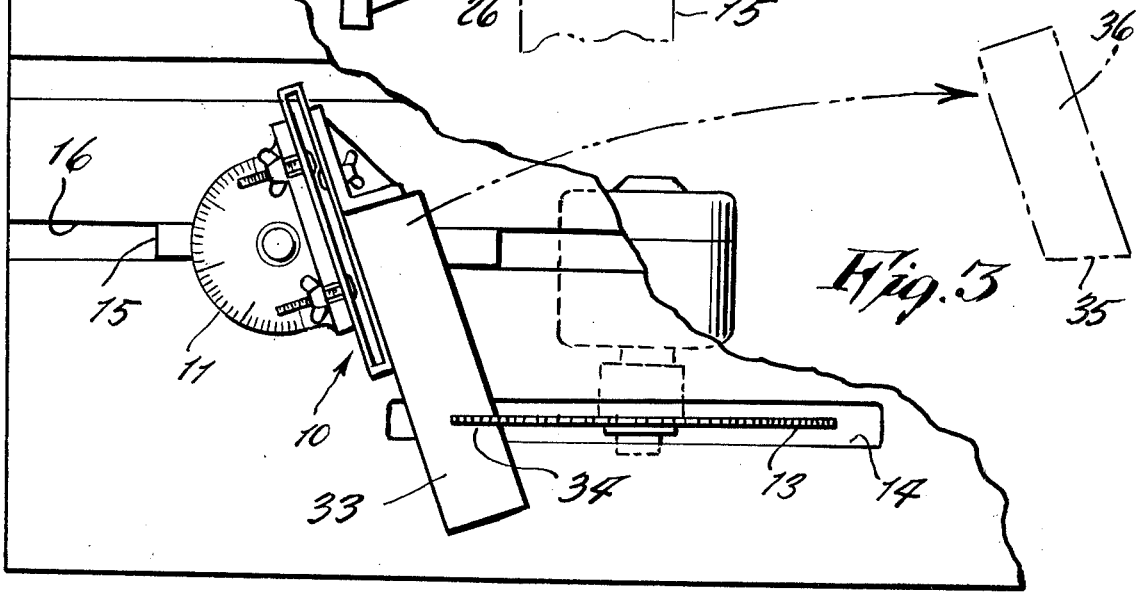
FIG. 3 is a top view of a circular saw table showing the invention installed thereupon and in use.

By rotationally adjusting the mitre gauge to a desired angle, as shown in FIG. 3, a plurality of wood pieces 33 can then have a saw cut 34 made across each, in succession, so that an end edge 35, thus made, makes each work piece 36 the same in length, the mitre gauge having determined the angle of the cut, and the rip fence position having determined the length of the finished wood piece.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. A table saw mitre gauge extension, comprising in combination, a pair of parallel, spaced apart front and back plates affixed together by spacers between opposite ends thereof, a pair of rearwardly extending bolts through said rear plate attaching said extension to a mitre gauge, and a pair of forwardly extending bolts through said front plate attaching a rip fence thereto; said pair of bolts through said rear plate extending through an elongated, single slot thereof, said pair of bolts through said front plate extending through a pair of parallel, elongated slots in said front plate, said slot of said rear plate being parallel to said slots of said front plate, the heads of all said bolts being in a space formed between said plates, and threaded ends of said bolts extending outwardly from said extension being fitted with adjustable wing nuts; said extension accordingly being slidably adjusted on said mitre gauge, and said rip fence being slidably adjusted on said extension.

2. The combination as set forth in claim 1 wherein said extension is located on either side of a saw blade of a table.

* * * * *